US010537769B2

(12) United States Patent
Onuki et al.

(10) Patent No.: US 10,537,769 B2
(45) Date of Patent: Jan. 21, 2020

(54) GOLF CLUB HEAD

(71) Applicant: Sumitomo Rubber Industries, Ltd., Kobe-shi, Hyogo (JP)

(72) Inventors: Masahide Onuki, Kobe (JP); Hiroshi Hasegawa, Kobe (JP); Hiromasa Tsunashima, Kobe (JP)

(73) Assignee: SUMITOMO RUBBER INDUSTRIES, LTD., Kobe-Shi, Hyogo (JP)

( * ) Notice: Subject to any disclaimer, the term of this patent is extended or adjusted under 35 U.S.C. 154(b) by 0 days.

(21) Appl. No.: 15/954,215

(22) Filed: Apr. 16, 2018

(65) Prior Publication Data

US 2018/0296888 A1 Oct. 18, 2018

(30) Foreign Application Priority Data

Apr. 17, 2017 (JP) ..... 2017-081034

(51) Int. Cl.
*A63B 53/04* (2015.01)

(52) U.S. Cl.
CPC .. *A63B 53/0466* (2013.01); *A63B 2053/0412* (2013.01); *A63B 2053/0437* (2013.01)

(58) Field of Classification Search
CPC ..... A63B 2053/0433; A63B 2053/0437
USPC ..... 473/345, 350, 338, 339
See application file for complete search history.

(56) References Cited

U.S. PATENT DOCUMENTS

| | | | | |
|---|---|---|---|---|
| 5,158,296 | A * | 10/1992 | Lee | A63B 53/04 473/327 |
| 7,857,711 | B2 * | 12/2010 | Shear | A63B 53/0466 473/329 |
| 8,632,419 | B2 * | 1/2014 | Tang | A63B 53/04 473/329 |
| 8,651,973 | B2 * | 2/2014 | Okot | A63B 53/0466 473/317 |
| 2004/0009829 | A1 * | 1/2004 | Kapilow | A63B 53/04 473/342 |
| 2005/0124435 | A1 * | 6/2005 | Gambetta | A63B 53/04 473/327 |
| 2010/0022325 | A1 * | 1/2010 | Doran | A63B 53/0466 473/327 |

FOREIGN PATENT DOCUMENTS

| | | |
|---|---|---|
| JP | 2002-052099 A | 2/2002 |
| JP | 2014-180540 A | 9/2014 |

* cited by examiner

*Primary Examiner* — Raeann Gorden
(74) *Attorney, Agent, or Firm* — Birch, Stewart, Kolasch & Birch LLP

(57) ABSTRACT

A hollow golf club head comprises a face part having a face for striking a ball, and a main body extending rearward from the face part. The main body is provided with a low-rigidity zone which comprises through holes and connecting portions arranged alternately along a peripheral edge of the face. The through holes penetrate the main body from the outside to the inside of the main body. The connecting portions extend in the front-back direction of the head, and include an oblique connecting portion comprising an oblique part inclined with respect to the front-back direction.

24 Claims, 13 Drawing Sheets

GOLF CLUB HEAD

TECHNICAL FIELD

The present invention relates to a golf club head, more particularly to a hollow golf club head.

BACKGROUND ART

Heretofore, various attempts to improve the rebound performance of a golf club head have been made in order to increase the flight distance of the ball.

The following Patent Documents 1 and 2 disclose hollow golf club heads, wherein a wall defining the top portion (or crown portion) of the head is provided with a flexure protruding toward the inner cavity of the head.

Patent Document 1: Japanese Patent Application Publication No. 2002-52099

Patent Document 2: Japanese Patent Application Publication No. 2014-180540

SUMMARY OF THE INVENTION

Problems to be Solved by the Invention

In the golf club head provided with the flexure, the wall can be deflected relatively largely at the flexure when the club face hits a ball. Such deflection is known to enhance the rebound performance of the golf club head. However, there is a problem such that, by the provision of the additional flexure, the weight of the golf club head is inevitably increased. The increase in the weight may force the head to reduce its volume, or results in a golf club which is relatively hard to swing, for example.

It is therefore, an object of the present invention to provide a golf club head capable of improving the rebound performance while preventing an undesirable increase in the head weight.

According to one aspect the present invention, a hollow golf club head comprises:

a face part having a face for striking a ball, and a main body extending rearward from the face part, wherein the main body is at least partially provided with a low-rigidity zone, the low-rigidity zone is provided with through holes penetrating the main body from the outside to the inside of the main body, and comprises connecting portions extending in the front-back direction of the head, the through holes and the connecting portions are arranged alternately along a peripheral edge of the face, and the connecting portions include an oblique connecting portion comprising an oblique part inclined with respect to the front-back direction of the head.

Further, the hollow golf club head according to the present invention may have the following features (1)-(8):

(1) the main body comprises a crown portion in which the low-rigidity zone is provided;

(2) the main body comprises a sole portion in which the low-rigidity zone is provided;

(3) the main body comprises a side portion in which the low-rigidity zone is provided;

(4) the oblique part is inclined at an angle of from 20 to 70 degrees with respect to the front-back direction of the head;

(5) the oblique connecting portion further comprises a second oblique part inclined with respect to the front-back direction of the head to the opposite direction to the oblique part;

(6) the oblique connecting portion is bent in a v shape when viewed from the outside of the head;

(7) the second oblique part is inclined at an angle of from 20 to 70 degrees with respect to the front-back direction of the head;

(8) the wall thickness of the main body is increased in the connecting portions.

According to another aspect of the present invention, a golf club comprises the above-described golf club head and a club shaft.

Therefore, in the golf club head according to the present invention, the rebound performance can be improved, while preventing an undesirable increase in the head weight. Thus, it is possible to increase the flight distance of the ball.

In this application including the description and claims, dimensions, positions, directions and the like relating to the club head refer to those under a standard state of the club head unless otherwise noted.

Here, the standard state of a golf club head is such that the head is set on a horizontal plane HP so that the axis of the club shaft (not shown) is inclined at the specified lie angle while keeping the axis on a vertical plane VP, and the face forms the specified loft angle with respect to the horizontal plane HP. Incidentally, in the case of the club head alone, the center line of the shaft inserting hole can be used instead of the axis of the club shaft.

"Toe-heel direction" of the head is a direction (y) which is horizontal and parallel with the vertical plane VP.

"Front-back direction" of the head is a direction (x) which is horizontal and perpendicular to the vertical plane VP.

"Up-down direction" of the head is a direction (z) which is orthogonal to the direction (x) and the direction (y).

DESCRIPTION OF THE PREFERRED EMBODIMENTS

Figure 1:
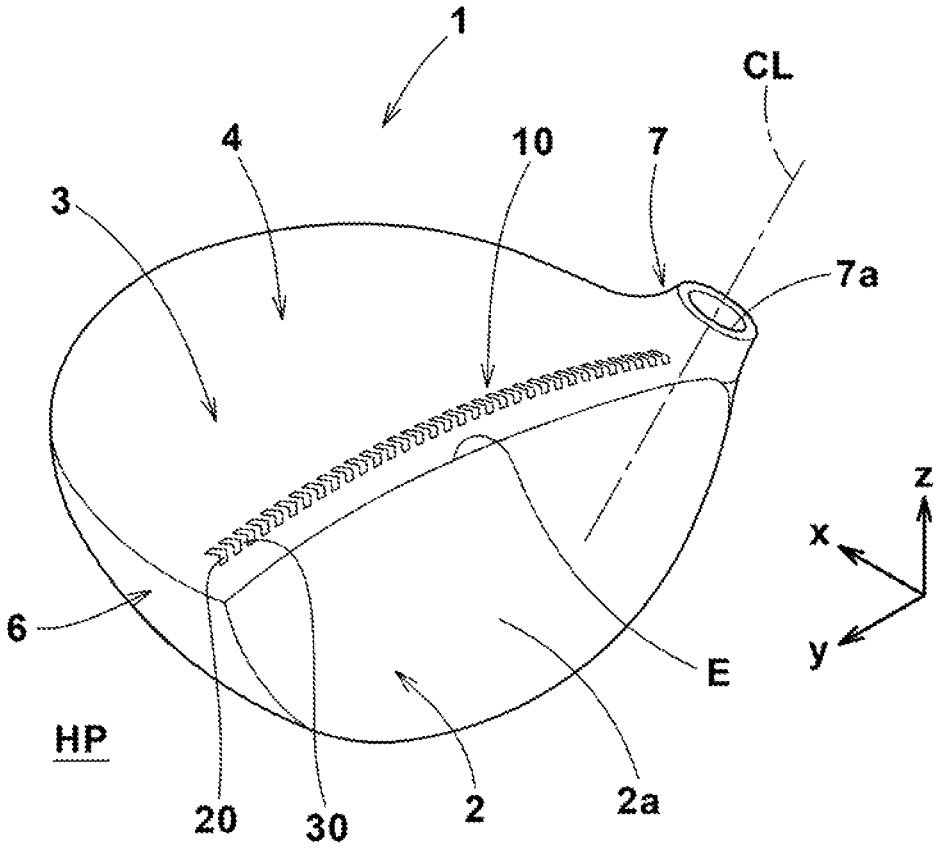
FIG. 1 is a perspective view of a golf club head as an embodiment of the present invention.

Embodiments of the present invention will now be described in detail in conjunction with accompanying drawings.

The following specific structures and configurations illustrated in connection with the embodiments and the drawings are only for the understanding of the present invention and the present invention is not limited to or by them.

In the following description, the same reference characters are used for the same or common elements of the different embodiments or examples, and redundant descriptions are omitted.

In the following embodiments, each golf club head 1 is a hollow head provided therein with an internal cavity (i), and formed to have a typical wood-type shape, for example, formed as a wood-type head for a driver.

Here, the term "wood-type" encompasses at least driver (#1), brassie (#2), spoon (#3), baffy (#4) and cleek (#5). Further, the wood-type heads include those having similar shapes to the heads for the above-listed golf clubs even though the golf club number or name is different therefrom.

Aside from such wood-type heads, the present invention may be applied to various heads such as utility-type and iron-type.

FIGS. 1-4 show a golf club head 1 as an embodiment of the present invention under its standard state.

In this embodiment, the head 1 is made from a metal material or metal materials.

For that purpose, various metal materials, for example, titanium, titanium alloys and stainless steels can be employed. However, it is also possible to employ non-metallic materials such as resins, rubber compounds, elastomers and fiber-reinforced resins so as to form a part of the head 1.

In this embodiment, the head 1 is composed of a face part 2 and a main body 3 extending backward from the face part 2.

The face part 2 has a front surface defining a club face 2*a* for striking a ball. The face part 2 has a back surface 2*b* exposed to the inner cavity (i). Thus, the face part 2 is formed in the form of a plate.

The main body 3 in this example comprises a crown portion 4, a sole portion 5 and a side portions 6 which are arranged so as to surround the inner cavity (i), together with the face part 2.

The crown portion 4 defines the upper surface of the head 1 continued from the face part 2.

The sole portion 5 defines the bottom surface of the head 1 continued from the face part 2.

The side portion 6 connects between the crown portion 4 and the sole portion 5 while extending from the toe side edge to the heel side edge of the face part 2.

By the face portion 2, crown portion 4, sole portion 5 and side portions 6, the inner cavity (i) is formed at the rear of the face part 2.

Figure 2:
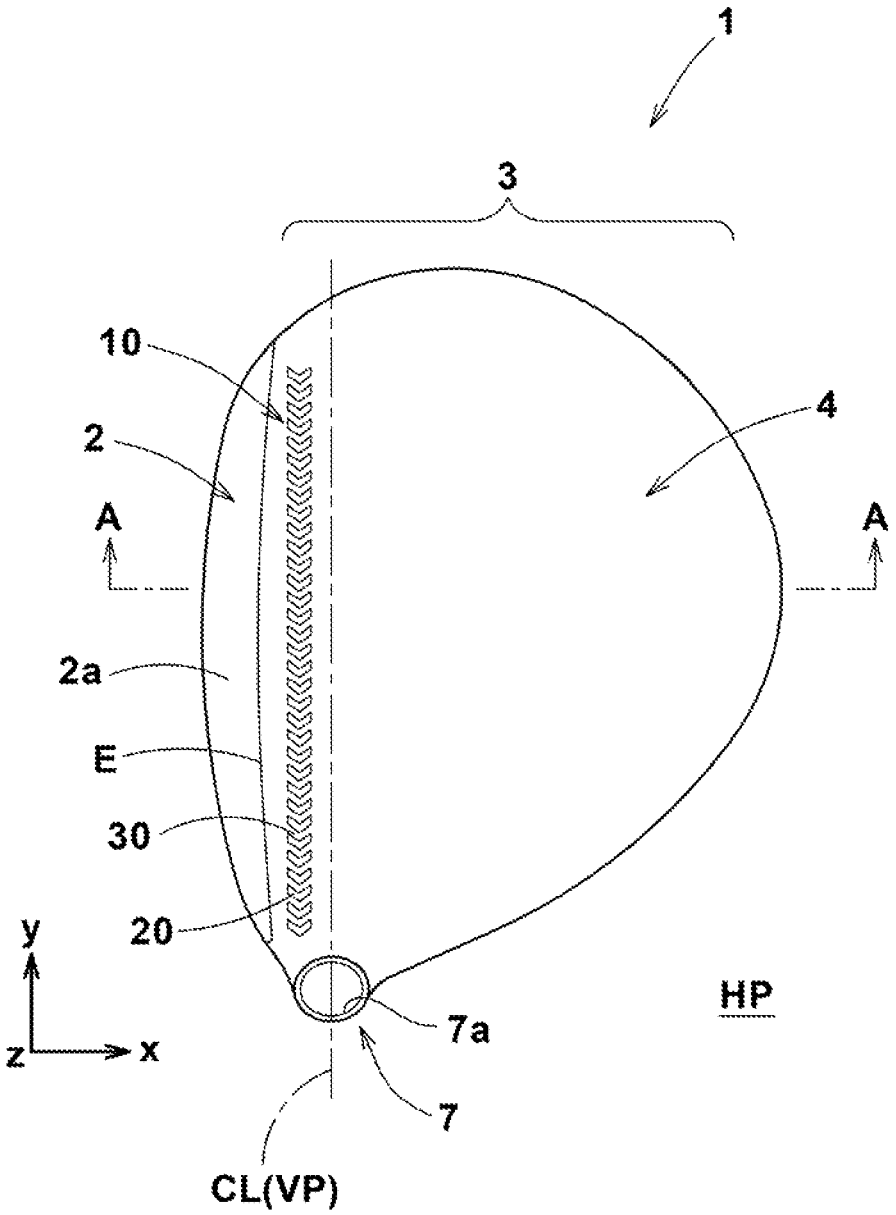
FIG. 2 is a top view thereof.
Figure 3:
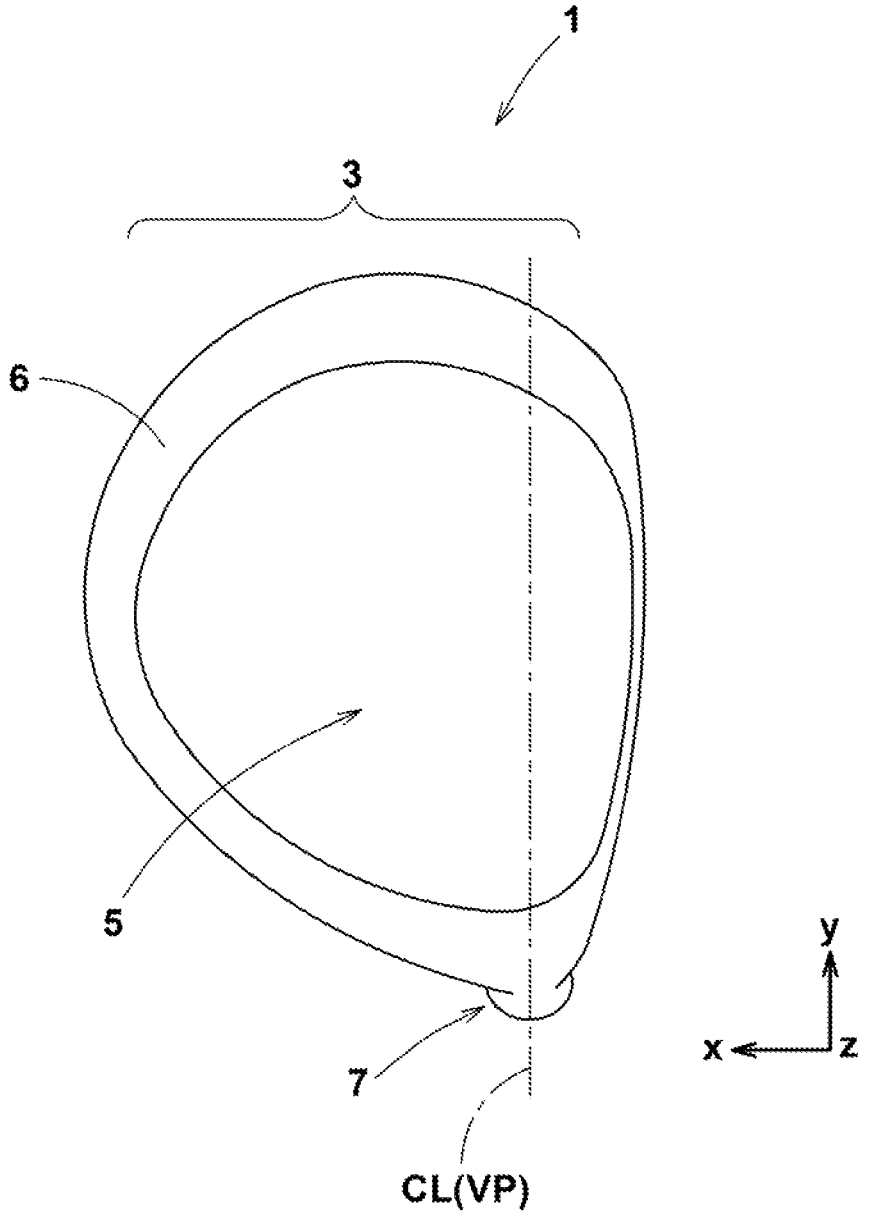
FIG. 3 is a bottom view thereof.

As shown in FIGS. 1 and 2, a hosel portion 7 may be provided on the heel side of the crown portion 4. In this example, the hosel portion 7 is formed as a tubular protrusion provided with a shaft inserting hole 7*a* into which the tip end of a club shaft (not shown) is fixed.

As explained above, the center line of the shaft inserting hole 7*a* can be used instead of the axis of the club shaft in order to establish the standard state of the head.

According to the present invention, the main body 3 of the head 1 is provided with a low-rigidity zone 10.

In this embodiment shown in FIGS. 1-4, the low-rigidity zone 10 is formed in the crown portion 4.

Figure 5:
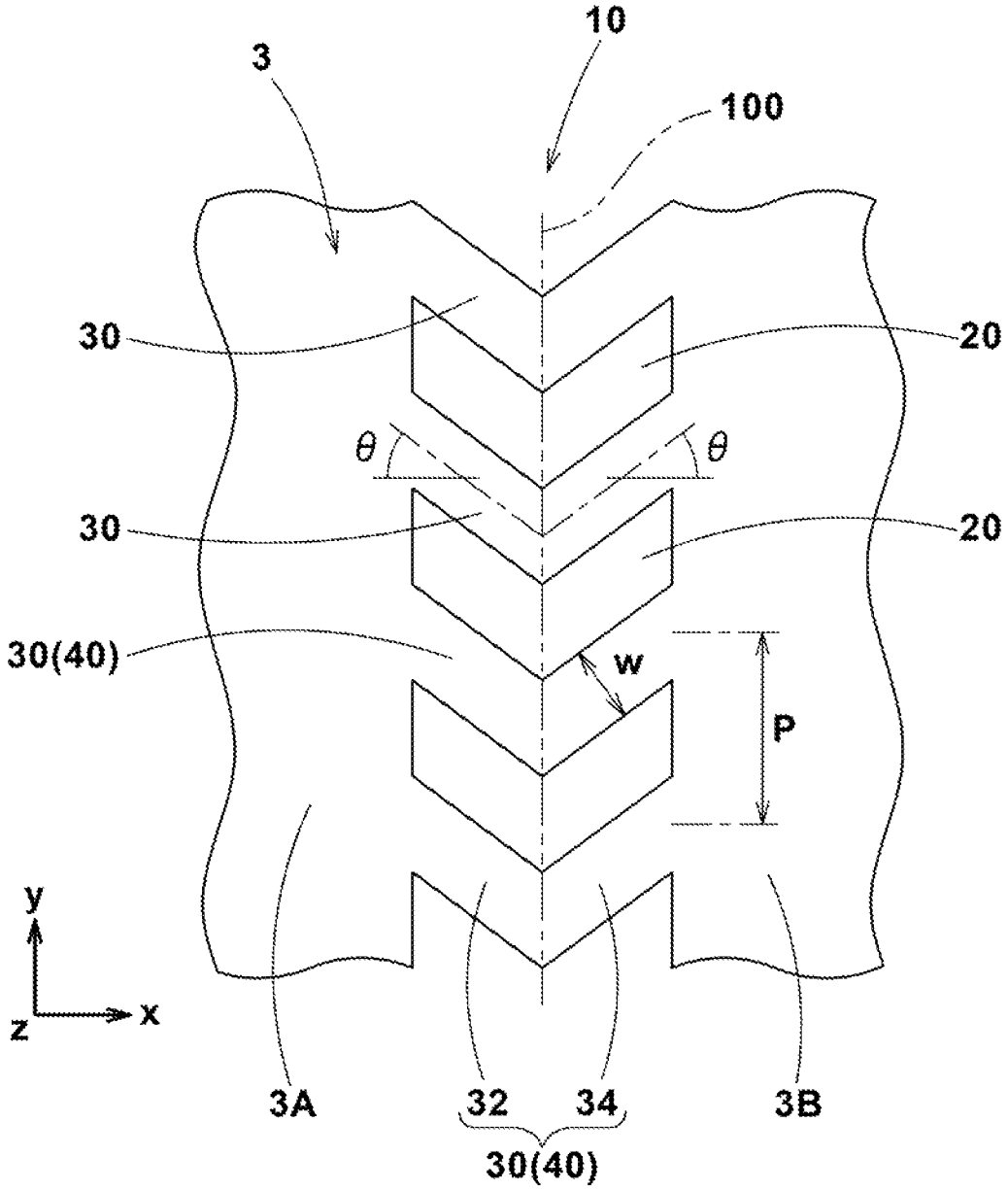
FIG. 5 is an enlarged partial view of the low-rigidity zone of the golf club head shown in FIG. 1.

The low-rigidity zone 10 comprises a plurality of through holes 20 and a plurality of connecting portions 30 as shown in FIG. 5. The through holes 20 and the connecting portions 30 are alternately arranged along the peripheral edge E of the face 2*a* shown in FIG. 2, therefore, the low-rigidity zone 10 extends along the peripheral edge E.

Figure 4:
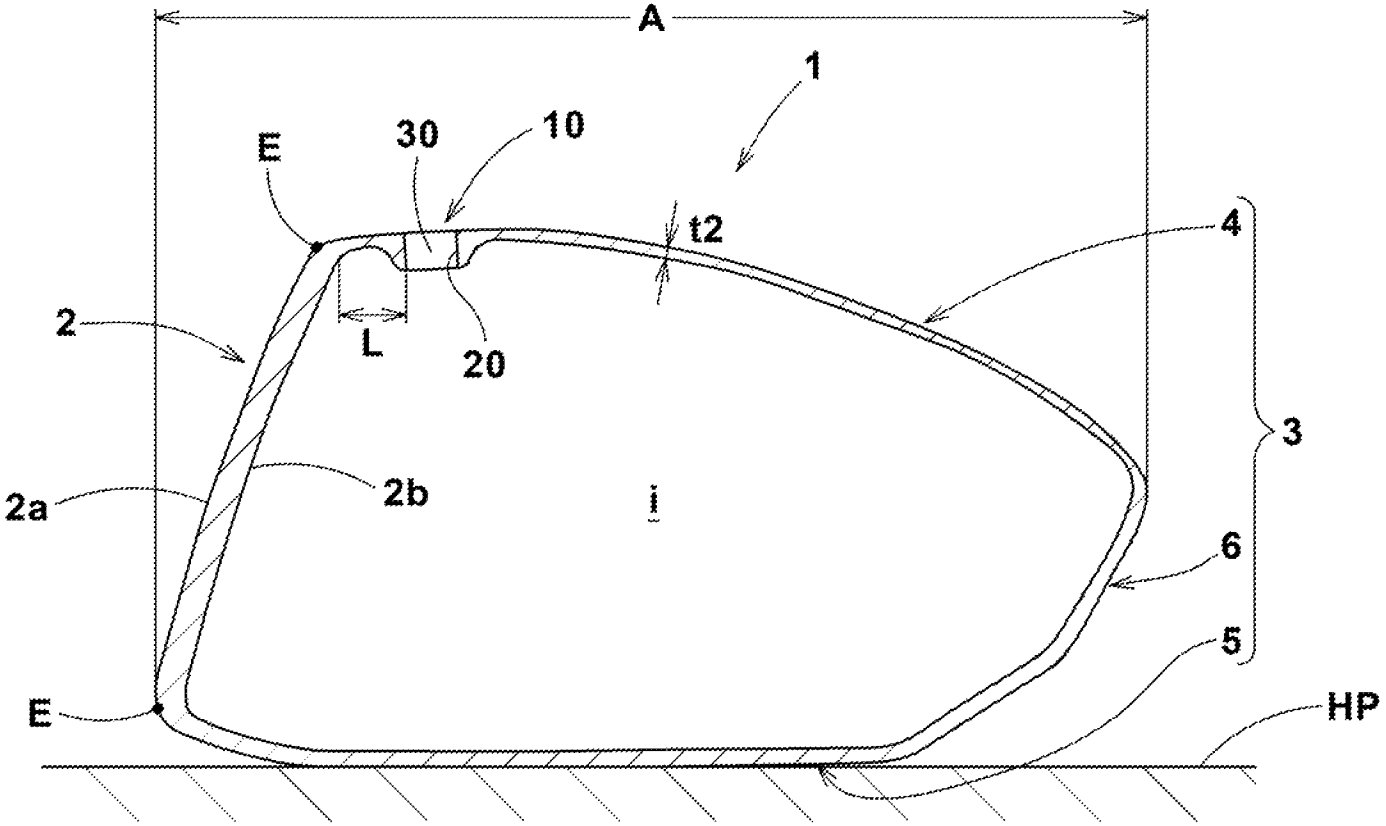
FIG. 4 is a cross sectional view of the golf club head taken along line A-A of FIG. 2.

The peripheral edge E of the face 2*a* is the boundary between the face 2*a* and the outer surface of the main body 3. If the peripheral edge E can be clearly identified by an edge line as shown in FIG. 4, the peripheral edge E is defined by the edge line. However, if the peripheral edge E can not be clearly identified due to the rounding of the edge, then, instead of the edge line, a line running through intermediate positions of the rounded curved surface is used for convenience sake.

The expression "along the peripheral edge E" means "parallel to the peripheral edge E" as well as "somewhat inclined with respect to the peripheral edge E". When inclined with respect to the peripheral edge E, the acceptable maximum inclination angle may be at least approximately 15 degrees. Specifically, the direction K in which the connecting portions 30 and the through holes 20 of the low-rigidity zone 10 are sequentially arranged, may have an angle of about 15 degrees with respect to the peripheral edge E of the face 2*a*.

When the peripheral edge E of the face 2*a* is a smoothly curved line, it is preferred that the low-rigidity zone 10 is also curved along the peripheral edge E.

But, it is also possible to configure the low-rigidity zone 10 as extending linearly. FIG. 2 shows an example of such linearly-extending low-rigidity zone 10. This example extends parallel to the toe-heel direction (y) of the head 1. In FIG. 2, the peripheral edge E is slightly curved, but it can be said as extending along the peripheral edge E in the sense explained above.

The through holes 20 penetrate through a wall of the main body 3 (in this embodiment, the wall is that of the crown portion 4) from the outside to the inside (inner cavity) of the head. The through holes 20 can decrease the volume of the material constituting the main body 3, thereby the weight of the main body 3 can be reduced. Further, the through holes 20 can reduce the rigidity of the main body 3 locally in the low-rigidity zone 10, which enables the main body 3 to make a relatively large deformation when the face 2*a* is hit by a ball.

It is possible to leave the through holes 20 void (opened).

Also it is possible to fill up the through holes 20 with a material which can not hinder the deformation of the through holes in substance and which has a lower specific gravity than the main body 3 such as rubber compounds and resins. This serves to prevent foreign objects from entering into the inner cavity of the head 1.

Between the through holes 20, there are formed the connecting portions 30 extend in the front-back direction of the head. The connecting portions 30 are formed integrally with the main body 3 and connect between a rear portion 3B of the main body 3 on the rear side of the through holes 20, and a front part of the head on the face side of the through holes 20, namely a front portion 3A of the main body 3 on the face side of the through holes 20 in this embodiment.

The connecting portions 30 include at least one oblique connecting portion 40.

The oblique connecting portion 40 comprises an oblique part 32, 34 which is inclined with respect to the front-back direction (x) of the head when viewed from the outside of the head in a direction perpendicular to the outer surface of the head.

During striking a ball, the front portion 3A of the main body 3 exerts a backward force on the oblique connecting portions 40. At this time, as the oblique parts 32, 34 are inclined with respect to the front-back direction (x), they can be easily elastically deformed toward the inclined direction, making bending deformation. Accordingly, it is possible for the main body 3 to deflect at the low-rigidity zone 10 during striking a ball, and thereby the rebound performance of the head 1 is improved.

As explained above, as the golf club head 1 is provided with the improved low-rigidity zone 10, the rebound performance of the head can be improved, without increasing the weight of the head.

In the case where the connecting portions extend in parallel with the front-back direction (x) of the head, there is a possibility that buckling occurs on the connecting portions. Specifically, such connecting portion that is being exerted by a backward force during striking a ball, exhibits a high rigidity in the early stage, but once the backward force exceeds a buckling load, the connecting portion is largely deformed at once. This may induce an unstable strength against deformation. Therefore, it is preferable that the great majority of the connecting portions 30 are the oblique connecting portions 40. More preferably, all the connecting portions 30 are the oblique connecting portions 40.

The oblique connecting portion 40 preferably comprises two oblique parts inclined with respect to the front-back direction (x) toward different directions, namely, a first oblique part 32 inclined in a first direction, and a second oblique part 34 inclined in a second direction opposite to the first direction.

In the example shown in FIG. 5, the oblique connecting portion 40 is made up of the first oblique part 32 and the second oblique part 34 arranged in a v-shape, therefore, the oblique connecting portion 40 can be said as being bent in a v-shape.

In the low-rigidity zone 10 in this embodiment, the v-shaped oblique connecting portions 40 are arranged side by side, therefore, the through holes 20 therebetween are also v-shaped.

As the oblique connecting portion 40 has the oppositely inclined first oblique part 32 and second oblique part 34, when striking a ball, the oblique connecting portion 40 is elastically deformed so as to reduce the angle formed between the two oblique parts 32 and 34. Thus, the oblique connecting portion 40 becomes more easily bent.

In order to derive such effect more effectively, it is preferred that the first oblique part 32 and the second oblique part 34 are inclined at an inclination angle θ of from 20 to 70 degrees, more preferably from 30 to 60 degrees with respect to the front-back direction (x) of the head.

As shown in FIG. 5, it is preferable that the configuration of each of the oblique connecting portions 40 is symmetrical about a line 100 extending in the longitudinal direction of the low-rigidity zone 10. This helps to prevent displacement in the direction of the line 100 possibly occurring between the front portion 3A of the main body 3 and the rear portion 3B of the main body 3 when the low-rigidity zone 10 is elastically deformed by striking a ball. In other words, that helps the low-rigidity zone 10 to deform only in the front-back direction (x).

Meanwhile, in order to facilitate the deformation of the oblique connecting portions during striking a ball, it is preferred that the oblique connecting portion has a asymmetric configuration about any line in the front-back direction (x).

The widths w and arrangement pitches P of the connecting portions 30 in the view from the outside of the head in the perpendicular direction thereto as shown in FIG. 5, can be arbitrarily defined according the material(s) constituting the main body 3, the desired level of improvement in the rebound performance and the like. For example, the widths w are set in a range of about 1 mm to about 3 mm, and the pitches P are set in a range of about 2 mm to about 10 mm.

In each of the connection portions 30, the width w can be constant or variable. In the connection portions 30, the widths w can be constant or different. The arrangement intervals P of the connection portions 30 can be constant or different. Here, the width w is measured in a direction perpendicular to the longitudinal direction of the oblique part.

By arranging the connecting portions 30 at substantially constant pitches P, the low-rigidity zone 10 may be substantially uniformly deflected.

The low-rigidity zone 10 is disposed in a position closer to the face part 2.

In this embodiment, as shown in FIG. 4, the low-rigidity zone 10 is spaced apart from the back surface 2*b* of the face part 2 by a non-zero distance L in the front-back direction.

The non-zero distance L is preferably set in a range of not more than 50%, more preferably not more than 30% of the maximum length (A) of the head 1 in the front-back direction of the head.

By providing the low-rigidity zone 10 near the face part 2, it becomes easy to decrease the difference between the primary natural frequency of a golf ball when a point on the outer surface of the ball is fixed, and the primary natural frequency of the head 1 when a central position of the face 2*a* is fixed which has a significant effect on the rebound performance (coefficient of restitution).

In the primary natural vibration mode of a general golf club head when a central position of the face is fixed, the face is mainly deformed (vibrates) and the main body 3 mainly acts as an inertia mass of the head. By reducing the stiffness of the zone of the main body 3 which is located closely to the face 2*a* so that the zone is deformed during striking a ball, the part of the main body 3 on the rear side of the zone becomes act as the mass of the head. Since the larger the mass, the lower the natural frequency, it is preferable that the low-rigidity zone 10 is formed closely to the face part 2.

Figure 6:
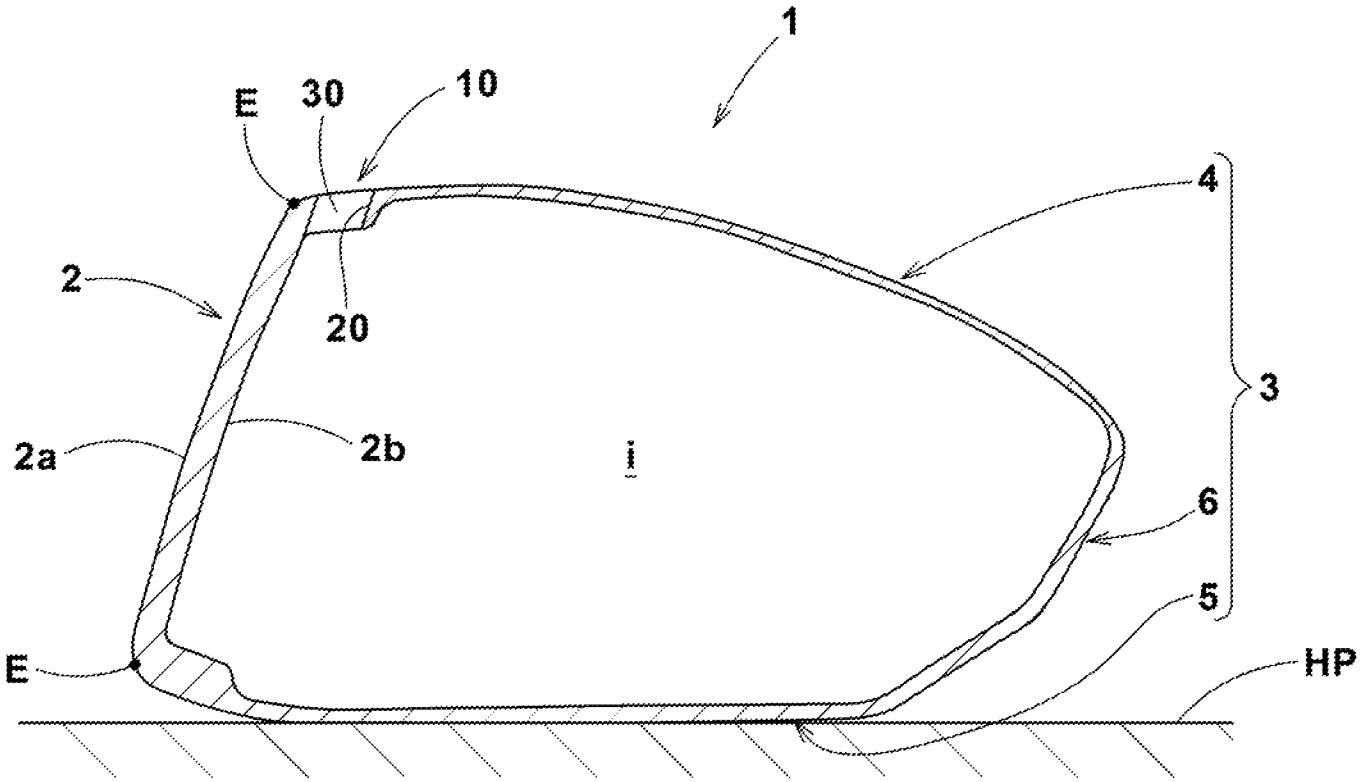
FIG. 6 is a cross sectional view showing a modification of the low-rigidity zone taken along a line corresponding the line A-A of FIG. 2.

FIG. 6 shows an embodiment in which the low-rigidity zone 10 is formed immediately behind the back side of the face part 2 (namely, the above-mentioned distance L is zero in substance). In this case, the rebound performance may be effectively increased by the low-rigidity-zone 10 even if its width in the front-back direction is narrow.

Figure 7:
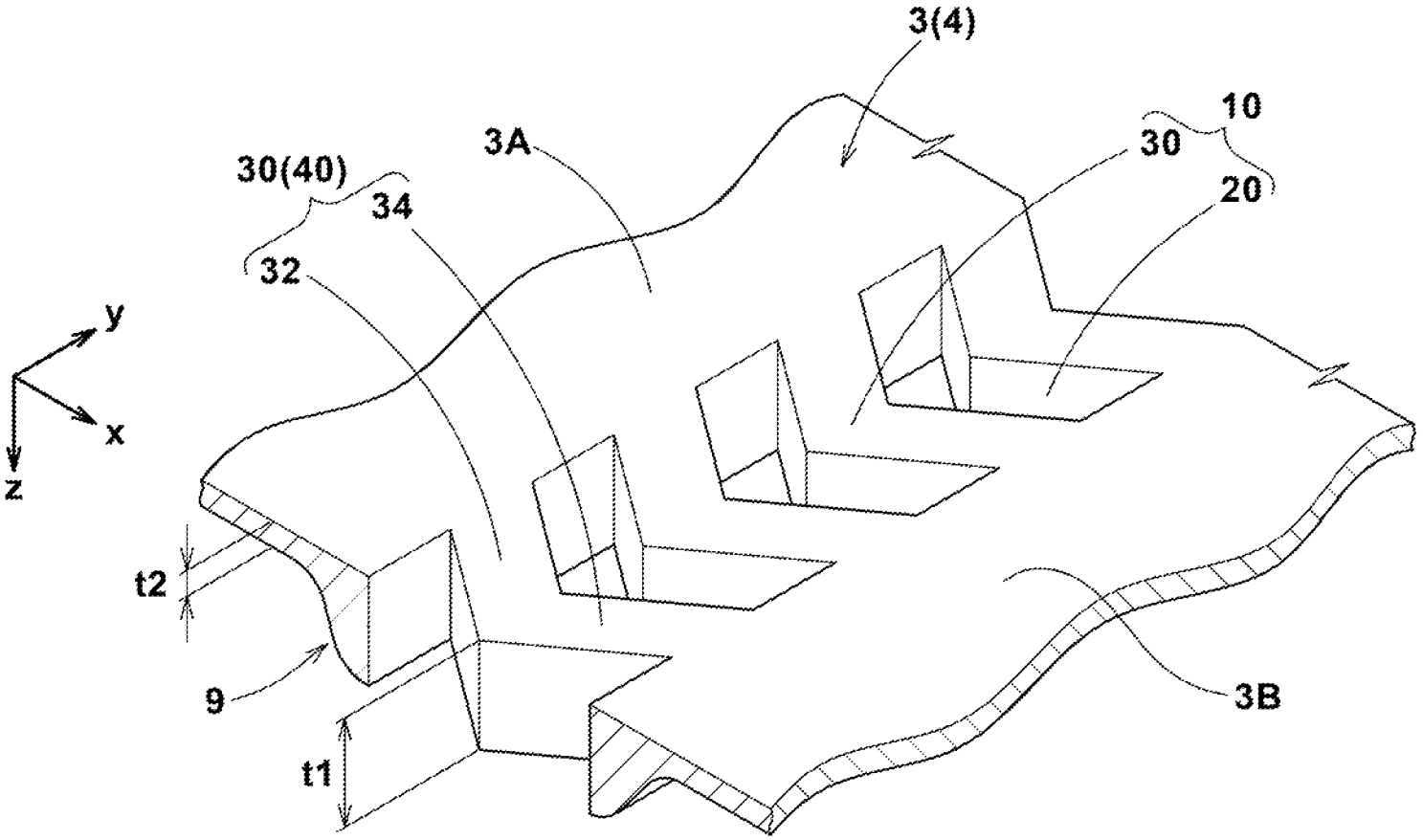
FIG. 7 is an enlarged perspective partial view of a modified example of the low-rigidity zone increased in the thickness.

FIG. 7 shows an example of the low-rigidity zone 10 in which the thickness t1 of each connecting portion 30 measured perpendicularly to the outer surface of the main body 3 at the position of the connecting portion 30 is increased from the thickness t2 (minimum thickness) of the other portion of the main body 3 than the connecting portions 30. That is, the thickness t1 of the connecting portions 30 is greater than the thickness t2 of the surrounding neighbor area of the main body 3. Such low-rigidity zone 10 can increase the out-of-plate shearing stiffness of the plate member (forming the crown portion in this embodiment) which is provided with the low-rigidity zone 10, while maintaining the reduced in-plate compressive stiffness in the front-back direction (x). Thus, it is possible to improve the durability of the head.

In order to avoid stress concentration, it is preferred that a thickness transition portion 9 whose thickness is smoothly changed from t1 to t2 is formed between the connecting portions 30 having the thickness t1 and the surrounding portion having the thickness t2.

Figure 8:
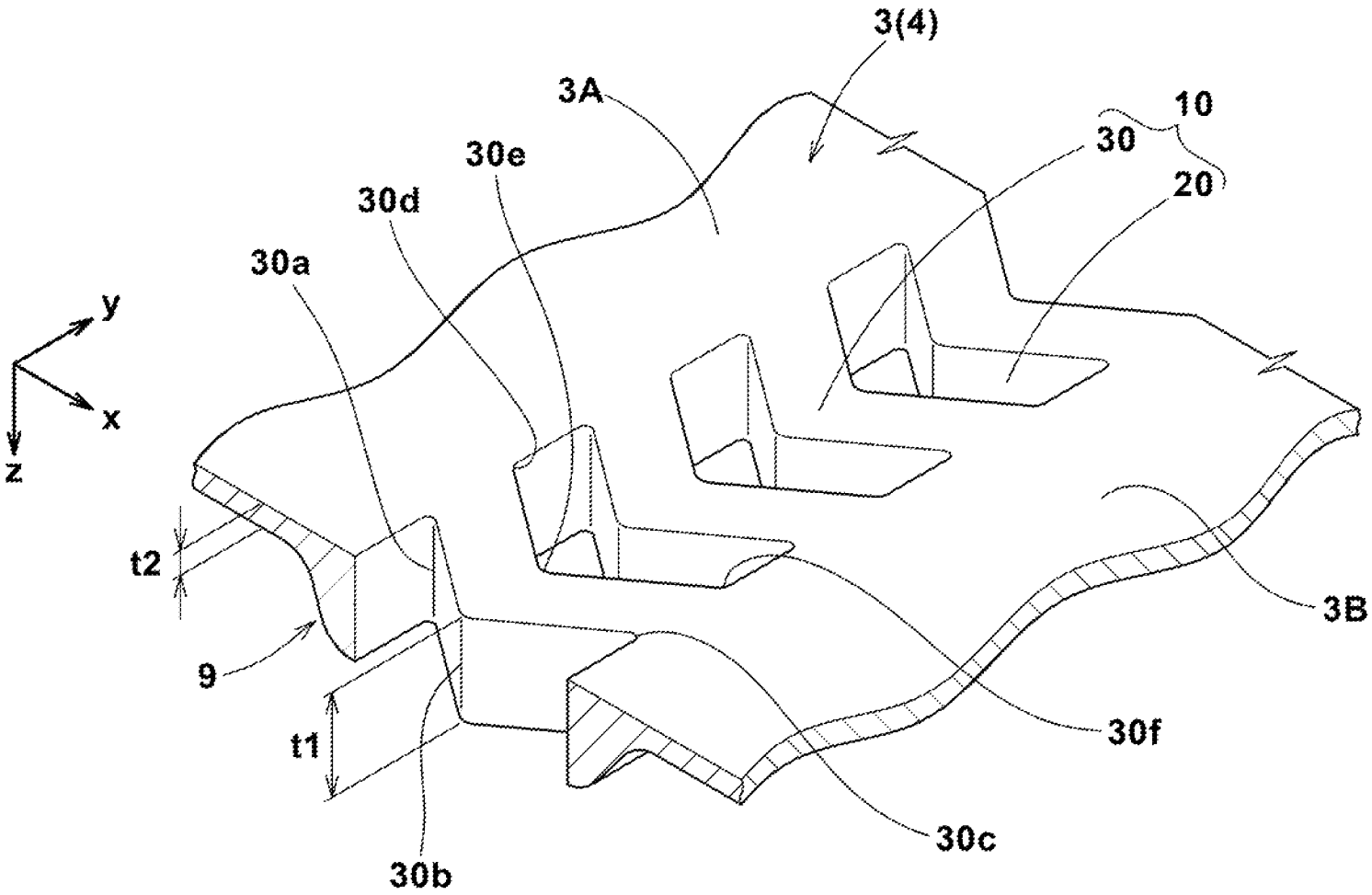
FIG. 8 is an enlarged perspective partial view of a modified example of the low-rigidity zone wherein corners are rounded.

FIG. 8 shows a modification of the low-rigidity zone 10 shown in FIG. 7, wherein corners 30*a*-30*f* of each of the connecting portions 30 are rounded by a smoothly curved surface such as a part of a cylindrical surface.

Such rounding is preferred in view of the prevention of a stress concentration on the corners 30*a*-30*f* possibly occurring at the time of striking a ball, in particular, the prevention of cracks occurring at the internal corners.

Aside from the present embodiment, the rounding of the corners is also preferred in other embodiments given later.

Figure 9:
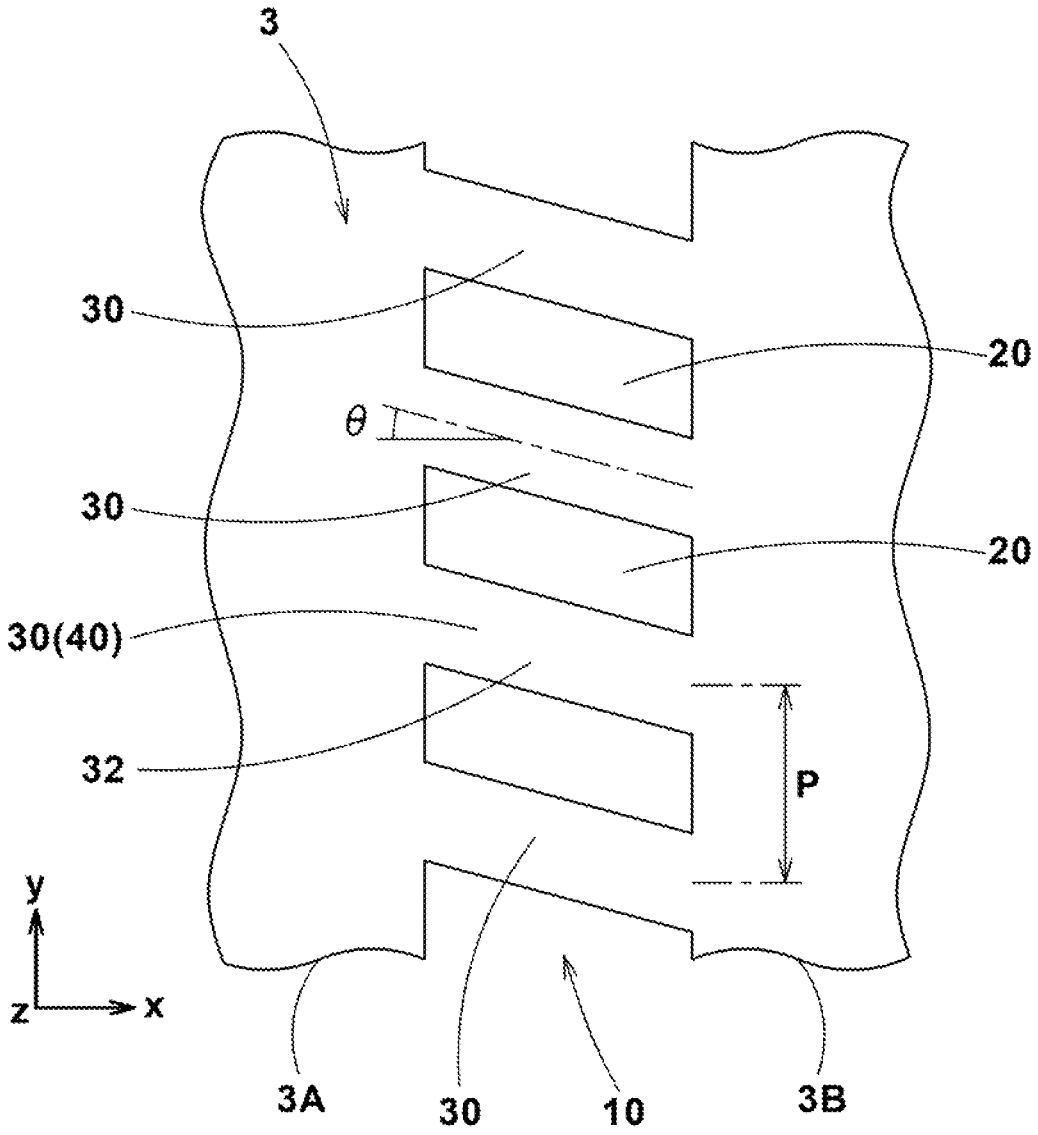
FIG. 9 is an enlarged partial view of another example of the low-rigidity zone.

FIG. 9 shows a part of another example of the low-rigidity zone 10 viewed from the outside of the main body 3 in a direction perpendicular to the outer surface of the main body 3.

In this example, the connecting portions 30 of the low-rigidity zone 10 are another type of the oblique connecting portion 40 consisting of a single oblique part which is the above-mentioned first or second oblique part 32 or 34. In this case too, it is preferred that the single oblique part 32 or 34 is inclined with respect to the front-back direction (x) at an angle θ of from 20 to 70 degrees, more preferably from 30 to 60 degrees with respect to the front-back direction (x) of the head.

Figure 10:
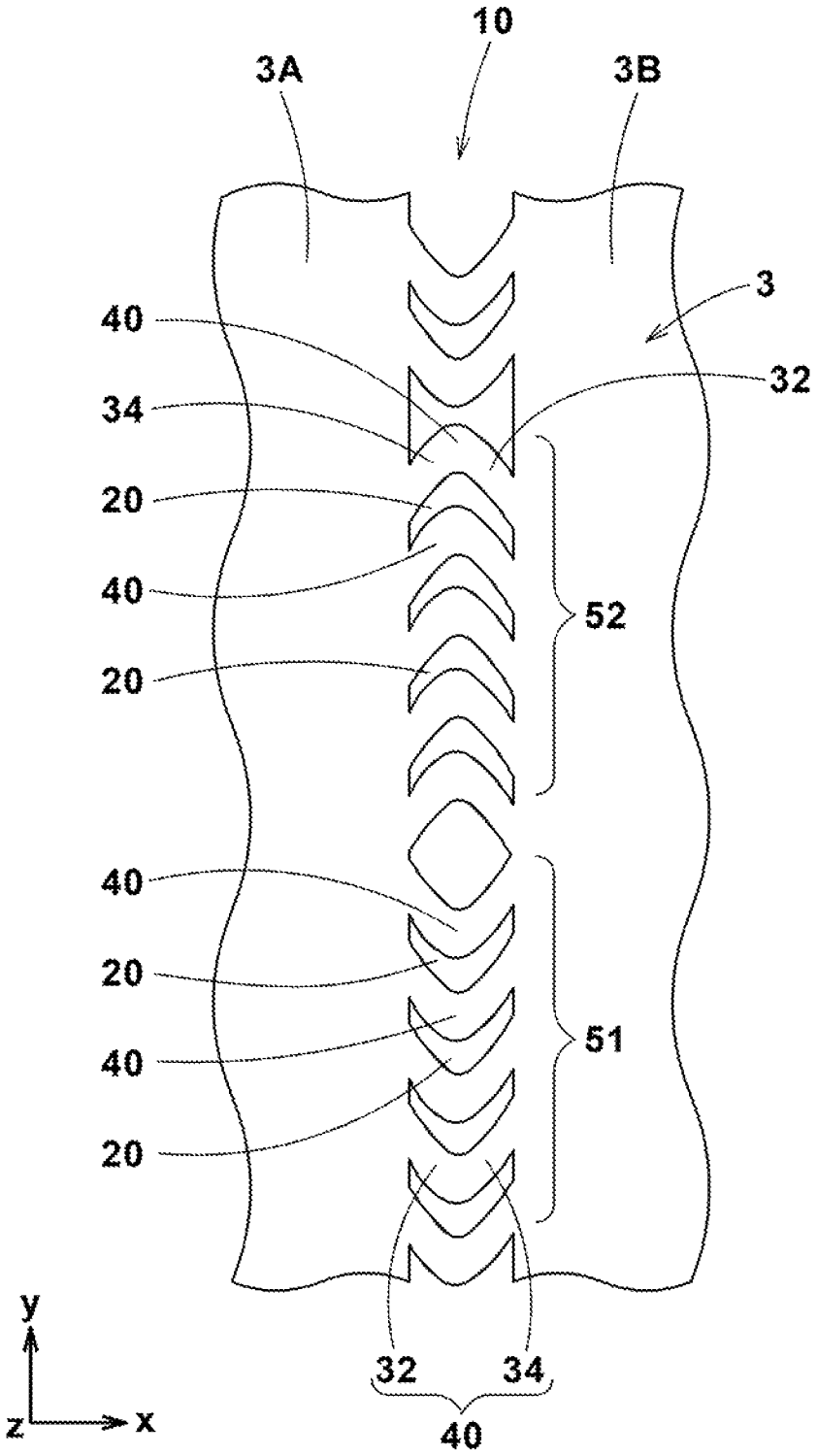
FIG. 10 is an enlarged partial view of another example of the low-rigidity zone.

FIG. 10 shows a part of still another example of the low-rigidity zone 10 viewed from the outside of the main body 3 in a direction perpendicular to the outer surface of the main body 3.

In this example, the connecting portions 30 of the low-rigidity zone 10 are the oblique connecting portions 40 which are two types of v-shaped oblique connecting portions 40 whose v-shapes are orientated toward different directions.

of a first portion 51 and a second portion 52 of the low-rigidity zone 10 arranged along the peripheral edge E of the face 2*a* in the example shown in FIG. 10, in the first portion 51, the oblique connecting portions 40 are arranged side-by-side so that their v-shapes are orientated toward one side in the longitudinal direction of the low-rigidity zone 10 (downward in the figure), whereas in the second portion 52, the oblique connecting portions 40 are arranged side-by-side so that their v-shapes are orientated toward the other side in the longitudinal direction of the low-rigidity zone 10 (upward in the figure).

Therefore, the first oblique parts 32 in the first portion 51 lie anterior to the second oblique parts 34, whereas the first oblique parts 32 in the second portion 52 lie posterior to the second oblique parts 34.

As a result, even if the oblique connecting portions 40 are asymmetrical about the line 100 extending in the longitudinal direction of the low-rigidity zone 10, a force component in the longitudinal direction of the low-rigidity zone 10 occurring from the oblique connecting portions 40 in the first portion 51 when deformed by striking a ball can be balanced out by a force component in the longitudinal direction of the low-rigidity zone 10 occurring from the oblique connecting portions 40 in the second portion 52.

Figure 11:
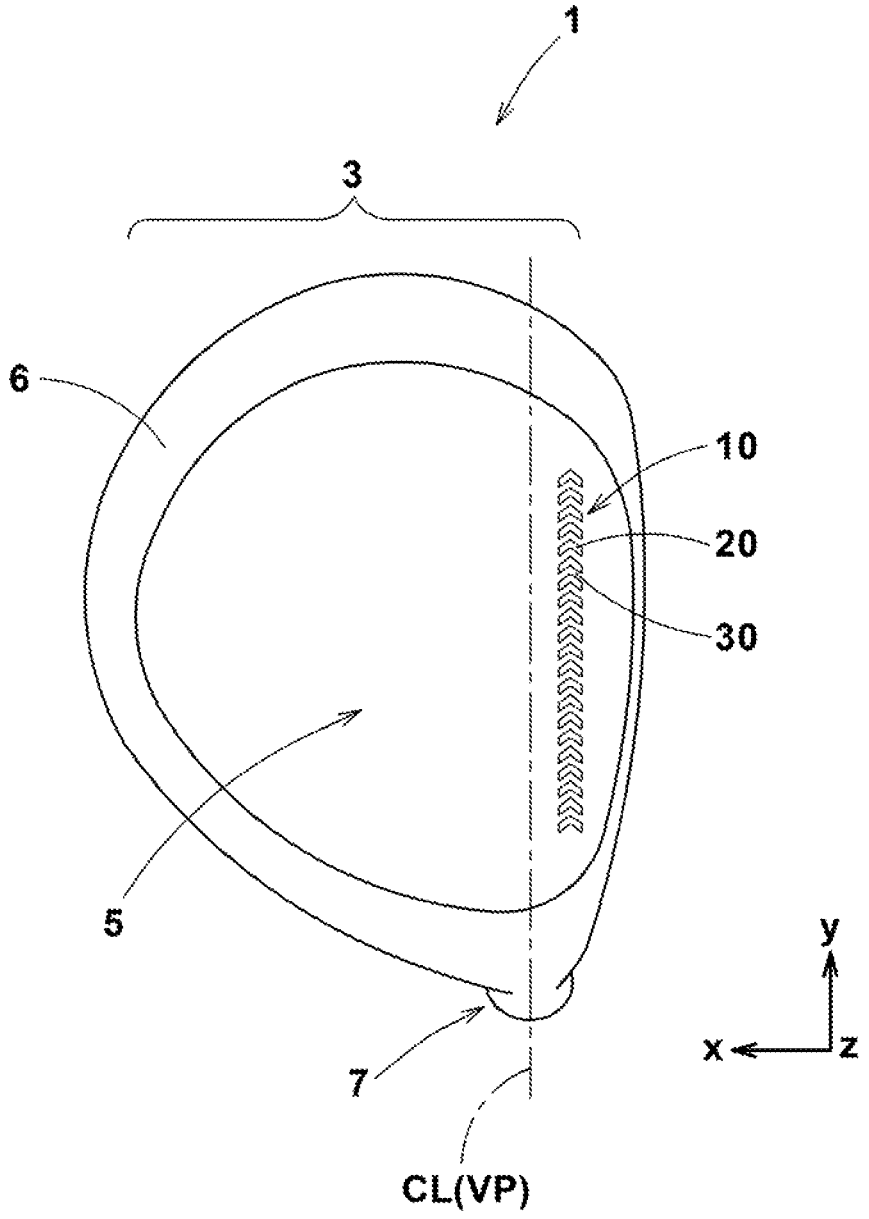
FIG. 11 is a bottom view of a golf club head as another embodiment of the present invention of which sole portion is provided with the low-rigidity zone.

FIG. 11 shows a golf club head as another embodiment of the present invention, wherein the low-rigidity zone 10 is disposed in the sole portion 5.

Figure 12:
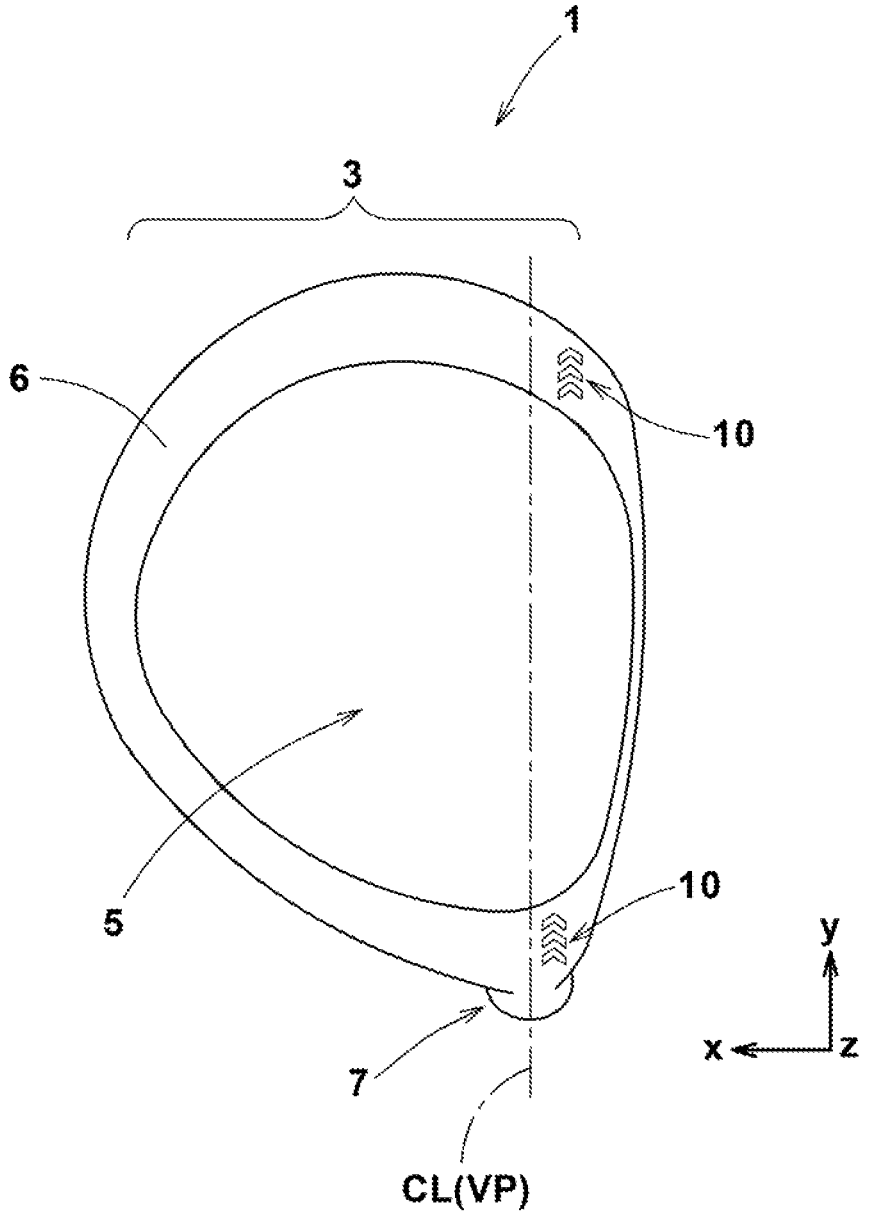
FIG. 12 is a bottom view of a golf club head as still another embodiment of the present invention of which side portion is provided with the low-rigidity zones.

FIG. 12 shows a golf club head as still another embodiment of the present invention, wherein the low-rigidity zone 10 is disposed in the side portion 6. In this case, the low-rigidity zone 10 can be formed in one of or each of a toe-side part and heel-side part of the side portion 6.

Figure 13:
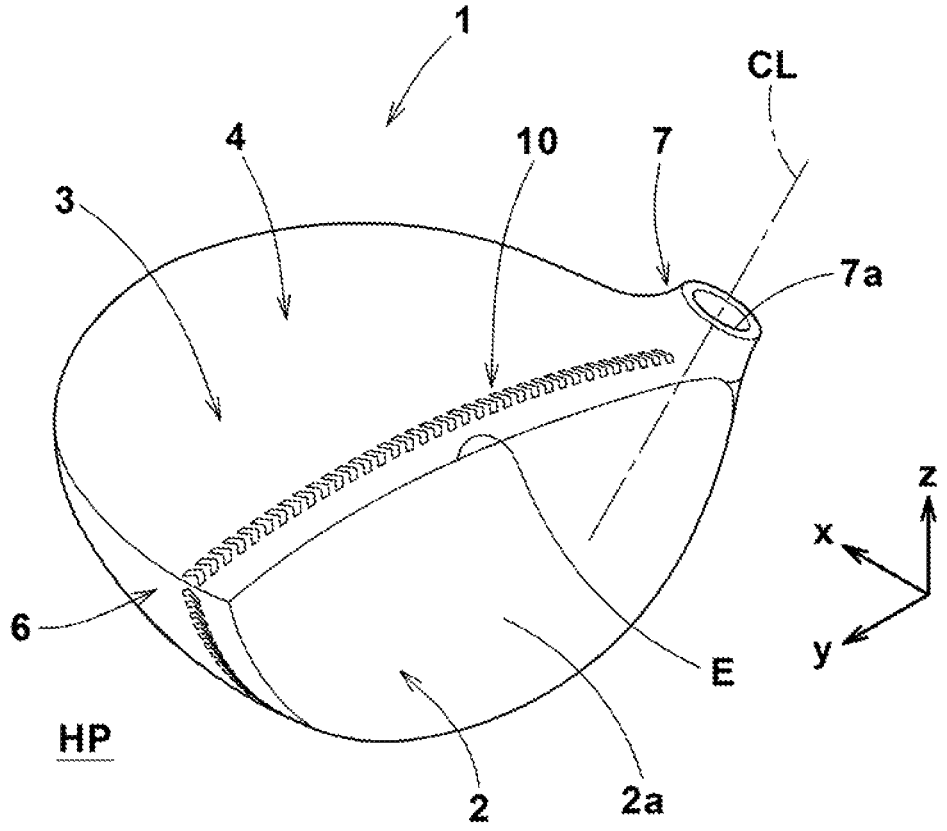
FIG. 13 is a perspective view of a golf club head as yet still another embodiment of the present invention in which the low-rigidity zone is disposed in at least two of the crown portion, side portions and sole portion.

FIG. 13 shows a golf club head as yet still another embodiment of the present invention, wherein the low-rigidity zone 10 is disposed in at least two of the crown portion 4, side portions 6 and sole portion 5. Thereby, in a relatively wider range, the stiffness of the main body 3 is appropriately reduced and the rebound performance can be improved.

In FIGS. 11-13, the low-rigidity zone 10 shown is the example shown in FIGS. 1, 2 and 5. But, needless to say, it is possible to adopt the other examples shown in FIGS. 9 and 10 (as to the configuration), FIG. 6 (as to the position in the front-back direction), FIG. 7 (as to the increased thickness) and FIG. 8 (as to the rounding of the corners).

While detailed description has been made of some embodiments of the present invention, the present invention can be embodied in various forms without being limited to the illustrated embodiments.

Further, an element and its modification and a feature described in conjunction with an embodiment may be employed in another embodiment as the corresponding element even if such suggestion is not made.

DESCRIPTION OF THE REFERENCE CHARACTERS

1 golf club head
2 face part
2*a* face
3 main body
4 crown portion
5 sole portion
6 side portion
10 low-rigidity zone
20 through hole
30 connecting portion
32 first oblique part
34 second oblique part
40 oblique connecting portions
E peripheral edge

The invention claimed is:

1. A hollow golf club head comprising:

a face part having a face for striking a ball, and a main body extending rearward from the face part, wherein the main body is provided with a low-rigidity zone, the low-rigidity zone comprises through holes and connecting portions which are arranged alternately along a peripheral edge of the face, the through holes penetrate the main body from the outside to the inside of the main body, the connecting portions are formed between the adjacent through holes and extend in the front-back direction of the head, and the connecting portions have a width of from 1 mm to 3 mm, and are arranged at pitches P of from 2 mm to 10 mm along said peripheral edge, the connecting portions include oblique connecting portions each comprising at least a first oblique connecting part inclined with respect to the front-back direction of the head, wherein said first oblique connecting part has a width of from 1 mm to 3 mm.

2. The golf club head according to claim 1, wherein the main body comprises a crown portion in which the low-rigidity zone is provided.

3. The golf club head according to claim 1, wherein the main body comprises a sole portion in which the low-rigidity zone is provided.

4. The golf club head according to claim 2, wherein the main body comprises a sole portion in which the low-rigidity zone is provided.

5. The golf club head according to claim 1, wherein the main body comprises a side portion in which the low-rigidity zone is provided.

6. The golf club head according to claim 2, wherein the main body comprises a side portion in which the low-rigidity zone is provided.

7. The golf club head according to claim 3, wherein the main body comprises a side portion in which the low-rigidity zone is provided.

8. The golf club head according to claim 1, wherein the first oblique connecting part is inclined at an angle of from 20 to 70 degrees with respect to the front-back direction of the head.

9. The golf club head according to claim 2, wherein the first oblique connecting part is inclined at an angle of from 20 to 70 degrees with respect to the front-back direction of the head.

10. The golf club head according to claim 3, wherein the first oblique connecting part is inclined at an angle of from 20 to 70 degrees with respect to the front-back direction of the head.

11. The golf club head according to claim 4, wherein the first oblique connecting part is inclined at an angle of from 20 to 70 degrees with respect to the front-back direction of the head.

12. The golf club head according to claim 1, wherein in addition to said first oblique connecting part, said oblique connecting portion further comprises a second oblique connecting part inclined with respect to the front-back direction of the head in a direction opposite to that of the first oblique connecting part, and the second oblique connecting part has a width of from 1 mm to 3 mm.

13. The golf club head according to claim 2, wherein in addition to said first oblique connecting part, said oblique connecting portion further comprises a second oblique connecting part inclined with respect to the front-back direction of the head in a direction opposite to that of the first oblique connecting part, and the second oblique connecting part has a width of from 1 mm to 3 mm.

14. The golf club head according to claim 3, wherein in addition to said first oblique connecting part, said oblique connecting portion further comprises a second oblique connecting part inclined with respect to the front-back direction of the head in a direction opposite to that of the first oblique connecting part, and the second oblique connecting part has a width of from 1 mm to 3 mm.

15. The golf club head according to claim 4, wherein in addition to said first oblique connecting part, said oblique connecting portion further comprises a second oblique connecting part inclined with respect to the front-back direction of the head in a direction opposite to that of the first oblique connecting part, and the second oblique connecting part has a width of from 1 mm to 3 mm.

16. The golf club head according to claim 5, wherein in addition to said first oblique connecting part, said oblique connecting portion further comprises a second oblique connecting part inclined with respect to the front-back direction of the head in a direction opposite to that of the first oblique connecting part, and the second oblique connecting part has a width of from 1 mm to 3 mm.

17. The golf club head according to claim 12, wherein said first and second oblique connecting parts of said oblique connecting portion are connected to each other in a V shape when viewed from the outside of the head.

18. The golf club head according to claim 12, wherein said second oblique connecting part is inclined at an angle of from 20 to 70 degrees with respect to the front-back direction of the head.

19. The golf club head according to claim 1, wherein the wall thickness of the main body is increased in the connecting portions.

20. A golf club comprising a club shaft and the golf club head according to claim 1.

21. The golf club head according to claim 1, wherein said connecting portion width is constant, and said connecting portion pitches P are constant.

22. The golf club head according to claim 1, wherein said connecting portion width is constant, and said connecting portion pitches P vary.

23. The golf club head according to claim 1, wherein said connecting portion width varies, and said connecting portion pitches P are constant.

24. The golf club head according to claim 1, wherein said connecting portion width varies, and said connecting portion pitches P vary.

* * * * *